US011220973B2

(12) United States Patent
Byeon

(10) Patent No.: US 11,220,973 B2
(45) Date of Patent: Jan. 11, 2022

(54) METHOD AND SYSTEM FOR COMPENSATING FOR FUEL INJECTION DEVIATIONS

(71) Applicants: HYUNDAI MOTOR COMPANY, Seoul (KR); KIA MOTORS CORPORATION, Seoul (KR)

(72) Inventor: Min Byeon, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 183 days.

(21) Appl. No.: 16/688,606

(22) Filed: Nov. 19, 2019

(65) Prior Publication Data

US 2021/0010439 A1 Jan. 14, 2021

(30) Foreign Application Priority Data

Jul. 9, 2019 (KR) ..... 10-2019-0082475

(51) Int. Cl.

| | |
|---|---|
| ***F02D 41/32*** | (2006.01) |
| ***F02D 41/14*** | (2006.01) |
| ***F02D 41/00*** | (2006.01) |
| ***F02D 41/24*** | (2006.01) |
| *F02D 41/34* | (2006.01) |

(52) U.S. Cl.

CPC ..... *F02D 41/32* (2013.01); *F02D 41/0085* (2013.01); *F02D 41/1498* (2013.01); *F02D 41/2454* (2013.01); *F02D 41/1458* (2013.01); *F02D 41/34* (2013.01)

(58) Field of Classification Search

CPC ..... F02D 41/0085; F02D 41/32; F02D 41/34; F02D 41/1458; F02D 41/1498; F02D 41/2454; F02D 2200/101; F02D 2200/1012

See application file for complete search history.

(56) References Cited

U.S. PATENT DOCUMENTS 5,915,359 A * 6/1999 Meyer ..... F02D 41/1405 123/436
6,070,567 A * 6/2000 Kakizaki ..... F02D 41/1498 123/406.25
2006/0021596 A1* 2/2006 Maeda ..... F02D 37/02 123/406.26

(Continued)

FOREIGN PATENT DOCUMENTS

DE 102007049615 A1 * 4/2009 ..... F02D 41/1498
KR 10-0534724 B1 12/2005
WO WO-2019141581 A1 * 7/2019 ..... F01N 11/00

*Primary Examiner* — John M Zaleskas

(74) *Attorney, Agent, or Firm* — Morgan, Lewis & Bockius LLP

(57) ABSTRACT

A method of compensating for fuel injection deviations of injectors includes: in a case of a low flow rate operating range, learning cylinder-specific lambda deviations regarding cylinder-specific engine roughness deviations using a characteristic map defining a relationship between engine roughness deviations and lambda deviations; calculating cylinder-specific amounts of injection compensation necessary to remove the cylinder-specific lambda deviations; and compensating for amounts of injection of injectors a by adding the cylinder-specific amounts of injection compensation to cylinder-specific target amounts of injection.

14 Claims, 7 Drawing Sheets

(56) References Cited

U.S. PATENT DOCUMENTS

2009/0093948 A1* 4/2009 Richert ..... F02D 41/1495 701/103
2009/0260419 A1* 10/2009 Maeda ..... F02D 19/0623 73/23.32
2009/0292440 A1* 11/2009 Ichihara ..... F02D 41/0097 701/102
2010/0017098 A1* 1/2010 Fukuchi ..... G01M 15/11 701/103
2010/0138135 A1* 6/2010 Hacker ..... F02D 41/0085 701/102
2010/0211291 A1* 8/2010 Sumitani ..... F02D 41/221 701/104
2010/0286892 A1* 11/2010 Aliakbarzadeh .... F02D 41/1497 701/103
2011/0100327 A1* 5/2011 Nakagawa ..... F02D 41/0085 123/445
2011/0214495 A1* 9/2011 Nishiumi ..... F02D 41/0025 73/114.49
2011/0226216 A1* 9/2011 Walker ..... F02D 35/023 123/339.1
2011/0239984 A1* 10/2011 Lee ..... F02D 41/1498 123/339.14
2011/0302999 A1* 12/2011 Porten ..... F02D 41/1498 73/114.31
2012/0138017 A1* 6/2012 Jentz ..... F02D 41/0025 123/436
2012/0253642 A1* 10/2012 Kitano ..... F02D 41/1498 701/104
2012/0255531 A1* 10/2012 Kinose ..... F02D 41/1497 123/673
2012/0283936 A1* 11/2012 Hashemi ..... F02D 41/2454 701/113
2012/0303248 A1* 11/2012 Hakariya ..... F02D 41/1498 701/104
2012/0330533 A1* 12/2012 Noda ..... F02D 41/0085 701/104
2013/0118243 A1* 5/2013 Jessen ..... F02M 65/00 73/114.45
2013/0184969 A1* 7/2013 Rollinger ..... F02D 41/22 701/103
2013/0317723 A1* 11/2013 Deubler ..... F02D 41/1495 701/104
2014/0090614 A1* 4/2014 Eser ..... F02D 13/0207 123/90.15
2014/0095053 A1* 4/2014 Oda ..... F02D 41/0082 701/104
2014/0129116 A1* 5/2014 Suzuki ..... F02D 41/1495 701/103
2014/0156170 A1* 6/2014 Eser ..... F02D 13/0226 701/103
2014/0156205 A1* 6/2014 Suzuki ..... F02D 41/1456 702/24
2014/0358403 A1* 12/2014 Brinkmann ..... F02D 41/0085 701/103
2016/0053701 A1* 2/2016 Iwase ..... G01M 15/11 123/673
2016/0363061 A1* 12/2016 Waisanen ..... F02D 41/1498
2017/0022918 A1* 1/2017 Pedro ..... F02D 41/064
2017/0122227 A1* 5/2017 Rollinger ..... F02D 41/1498
2018/0171921 A1* 6/2018 Park ..... F02D 41/22
2018/0283299 A1* 10/2018 Kondo ..... F02D 41/40
2021/0047973 A1* 2/2021 Martin ..... F02D 37/02

* cited by examiner

Result of reviewing injector of 1st cylinder, the quality of which is at lowest limit, and injector of another cylinder, the quality of which is at highest limit Flow rate of 1.35 msec area of 1st cylinder is 35% smaller than that of other cylinders
→ Fire is detected due to increased roughness of 1st cylinder

-PRIOR ART-

METHOD AND SYSTEM FOR COMPENSATING FOR FUEL INJECTION DEVIATIONS

CROSS REFERENCE TO RELATED APPLICATION

The present application claims priority to Korean Patent Application No. 10-2019-0082475, filed Jul. 9, 2019, the entire contents of which is incorporated herein for all purposes by this reference.

TECHNICAL FIELD

The present disclosure generally relates to a method and system for compensating for fuel injection deviations of injectors, in which injection flow rate deviations in an operation area for low flow rate injection are detected and injection flow rates are redistributed according to cylinders.

BACKGROUND

A duel port injection (DPI) system in which two injectors are provided in each cylinder was developed as a solution to improve fuel efficiency, emission, and performance by improving fuel atomization in a multipoint fuel injection (MPI) engine.

Although the DPI system improves fuel efficiency, the flow rate of each injector is halved compared to the flow rate of an existing injector. Thus, when the quality of an injector is at the lowest limit, the injector may not properly inject a target amount of fuel. Accordingly, flow rate control performance required in a low flow rate injection operating range, such as idling, may not be obtained.

Moreover, when an injector, the quality of which is at the lowest limit, is provided in a specific cylinder of the cylinders, an injection flow rate of the specific cylinder may be insufficient compared to those of the other cylinders. In this case, as illustrated in FIG. 1, the cylinder having the insufficient injection flow rate may not only cause increased engine roughness, but also a risk of fire, which is problematic.

Accordingly, at present, when the flow rate control performance is insufficient or disabled, a single injection mode may be used in a low flow rate injection operating range, such that fuel is not injected from one port with being injected from the other port. In this manner, a dual injection operation may be evaded in the low flow rate injection operating range.

However, when the dual injection operation is not performed, fuel efficiency and EM may be deteriorated. In addition, when the engine exits the low flow rate injection operating range and transits from the single injection mode to the dual injection mode, revolutions per minute (RPM) changes and air-fuel ratio changes are inevitable.

The foregoing is intended merely to aid in the understanding of the background of the present disclosure, and is not intended to mean that the present disclosure falls within the purview of the related art that is already known to those skilled in the art.

SUMMARY

The present disclosure has been made keeping in mind the above problems occurring in the related art, and the present disclosure is intended to propose a method and system for compensating for fuel injection deviations of injectors, injection flow rate deviations in an operation area for low flow rate injection are detected and injection flow rates are redistributed according to cylinders.

In order to achieve the above objective, according to one aspect of the present disclosure, a method of compensating for fuel injection deviations of injectors may include: in a low flow rate injection operating range, learning, by a controller, cylinder-specific lambda deviations regarding cylinder-specific engine roughness deviations using a characteristic map defining a relationship between engine roughness deviations and lambda deviations; calculating, by the controller, cylinder-specific amounts of injection compensation necessary to remove the cylinder-specific lambda deviations; and compensating for amounts of injection of injectors by adding the cylinder-specific amounts of injection compensation to cylinder-specific target amounts of injection.

Whether or not a condition of the low flow rate injection operating range is satisfied may be determined in accordance with a target injection time of the injector, revolutions per minute (RPM) of an engine, and a vehicle speed.

Whether or not a condition of compensation for the amounts of injection is satisfied may be determined in accordance with whether or not a purging operation is active, a coolant temperature, and the engine roughness deviation.

If a target injection time of the injector is within a predetermined time, RPM of an engine are less than predetermined RPM, and a vehicle speed is less than a predetermined vehicle speed, the low flow rate injection operating range may be determined to be satisfied.

If a purging operation is inactivated, a coolant temperature exceeds a predetermined temperature, and a maximum value of the engine roughness deviations exceeds a predetermined value, the injection compensation operating condition may be determined to be satisfied.

The learning of the cylinder-specific lambda deviations may include: detecting cylinder-specific values of engine roughness; calculating an engine roughness average of the cylinder-specific values of engine roughness; calculating cylinder-specific engine roughness deviations from differences between the engine roughness average and the cylinder-specific values of engine roughness; calculating cylinder-specific lambda deviations regarding the cylinder-specific engine roughness deviations using the characteristic map; and learning the cylinder-specific lambda deviations by integrating the cylinder-specific lambda deviations.

The learning of the cylinder-specific lambda deviations may further include: calculating a lambda deviation average of the cylinder-specific lambda deviation; when the lambda deviation average is not 0, compensating the lambda deviation average to be 0 by subtracting the lambda deviation average from the cylinder-specific lambda deviations; and when the lambda deviation average is 0, learning the cylinder-specific lambda deviations by integrating the cylinder-specific lambda deviations.

The cylinder-specific lambda deviations may be learned by reflecting table values of integration constants corresponding to the cylinder-specific lambda deviations.

The calculation of the cylinder-specific amounts of injection compensation may include: calculating a cylinder-specific lambda from the cylinder-specific lambda deviations; calculating cylinder-specific injection distribution values necessary for the cylinder-specific lambda to form a lambda average; calculating cylinder-specific compensation injection values by subtracting an injection value corresponding to lambda 1 from the cylinder-specific injection distribution values; and calculating cylinder-specific amounts of injection compensation by multiplying cylinder-specific compensation injection values with cylinder-specific target amounts of injection.

In the calculation of the cylinder-specific amounts of injection compensation, when a dual-injector structure in which two injectors are provided in each of cylinders is used, injector-specific amounts of injection compensation of the cylinders may be calculated by multiplying the compensation injection values with injector-specific target amounts of injection of the cylinders.

The amounts of injection compensation may be multiplied with a compensation factor according to a target injection time, where 0≤the compensation factor≤1.

After the compensation for the amounts of injection, when the engine roughness deviation of a cylinder among the cylinders, in which the compensation for the amounts of injection is completed, is equal to or greater than a predetermined value, the cylinder-specific lambda deviation of the cylinder may be rest to an initial value.

The method may further include: after the compensation for the amounts of injection, calculating lambda deviation differences between the initial cylinder-specific lambda deviations and the current cylinder-specific lambda deviations; when a maximum value among the lambda deviation differences exceeds a predetermined value, calculating an engine roughness deviation difference between the initial engine roughness deviation and the current engine roughness deviation of the corresponding cylinder; and when the engine roughness deviation difference exceeds a predetermined value, resetting the learned lambda deviation of the corresponding cylinder to an initial value.

In order to achieve the above objective, according to another aspect of the present disclosure, a system for compensating for fuel injection deviations of injectors may include a controller configured to: determine whether or not an injection compensation operating condition is satisfied in a low flow rate injection operating range, in accordance with output values reflecting traveling states of a vehicle; learn cylinder-specific lambda deviations regarding cylinder-specific engine roughness deviation using a characteristic map defining relationship between engine roughness deviations and lambda deviations; calculate cylinder-specific amounts of injection compensation necessary for removing the cylinder-specific lambda deviations; and compensate for amounts of injection compensation of injectors by adding the cylinder-specific amounts of injection compensation to the cylinder-specific target amounts of injection.

The controller may be further configured to determine whether or not an injection compensating operation is effective to reduce the engine roughness deviations by determining whether or not the engine roughness deviation of a cylinder, in which the compensation for the amounts of injection compensation is completed, is equal to or greater than a predetermined value.

According to embodiments of the present disclosure, cylinder-specific lambda deviations are obtained as the relationship between engine roughness deviations and lambda deviations in a low flow rate injection operating range. Injection deviations are compensated for in a cylinder-specific manner to reduce the cylinder-specific lambda deviations. Thus, the dual injection mode may be extensively used in the low flow rate operating range. This can improve fuel efficiency and an EM while preventing changes in the revolutions per minute (RPM) or air-fuel ratio occurring in injection mode transition, since the transition from a dual injection mode to a single injection mode is unnecessary.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Hereinafter, exemplary embodiments of the present disclosure will be described in detail with reference to the accompanying drawings.

Hereinafter, a controller (CLR) according to exemplary embodiments of the disclosure may be realized using an algorithm designed to control operations of a variety of components of a vehicle or a nonvolatile memory (not shown) storing data regarding software instructions for performing the algorithm and a processor (not shown) configured to perform operations, which will be described later, using the data stored in the memory. Here, the memory and the processor may be implemented as individual chips. As an alternative, the memory and the processor may be integrated into a single chip. The processor may be one or more processors.

The present disclosure provides a method of determining an injection flow rate deviation as a relationship between engine roughness and lambda and compensating for the injection flow rate deviation. The method includes a step of learning a lambda deviation, a step of calculating an amount of injection compensation, and a step of compensating for the amount of injection compensation.

The present disclosure will be described in detail with reference to FIGS. 2 and 4. First, in the step of learning a lambda deviation, in the case of an operation area for low flow rate injection, the controller learns lambda deviations according to cylinders regarding cylinder-specific engine roughness (ER) deviations using a characteristic map defining the relationship of engine roughness deviations and lambda deviations.

Figure 6:
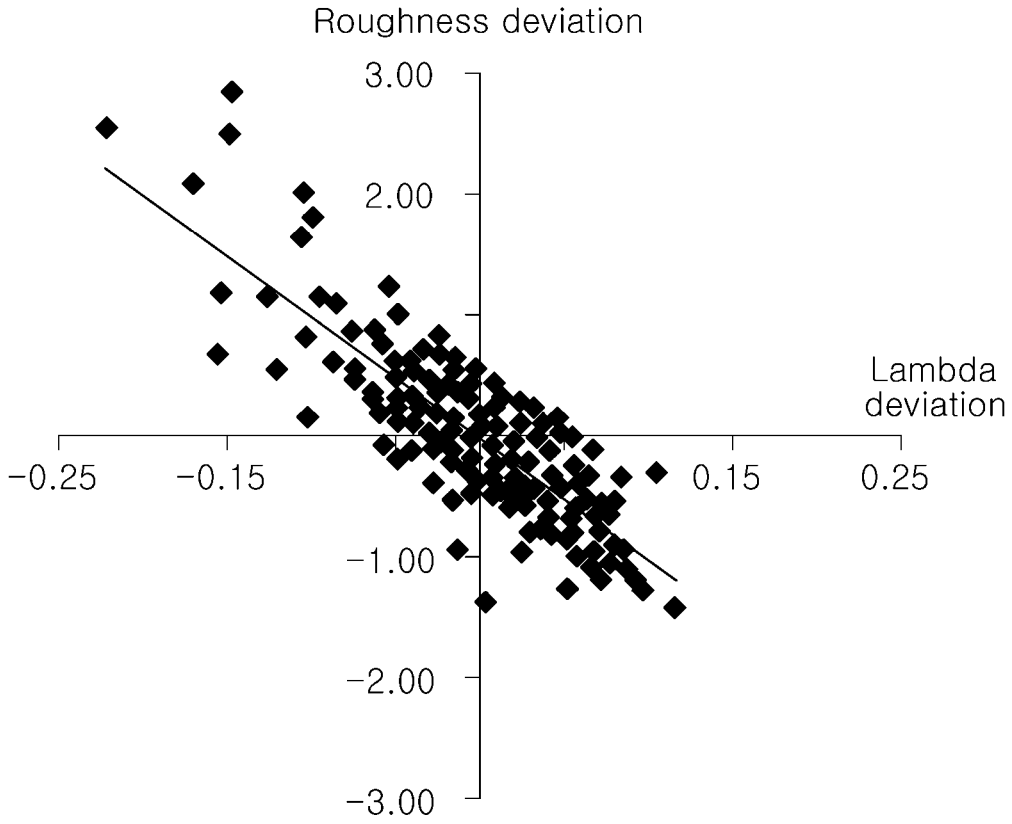
FIG. 6 is a graph illustrating the relationship between engine roughness deviations and lambda deviations used in the present disclosure.

Here, engine roughness deviations and lambda deviations are in a proportional relationship, as illustrated in FIG. 6. The characteristic map may be constructed using the linear relationship between engine roughness deviations and the lambda deviations.

In the step of calculating an amount of injection compensation, the controller calculates cylinder-specific amounts of injection compensation necessary to remove learned cylinder-specific lambda deviations.

For example, when a learned lambda deviation value of a cylinder exceeds zero (0), an amount of injection compensation, by which the learned lambda deviation is reduced to 0 (lambda=1), is calculated.

In addition, in the step of compensating for the amount of injection compensation, the controller compensates for an amount of injection of an injector by adding the cylinder-specific amount of injection compensation to a cylinder-specific target amount of injection.

Figure 7:
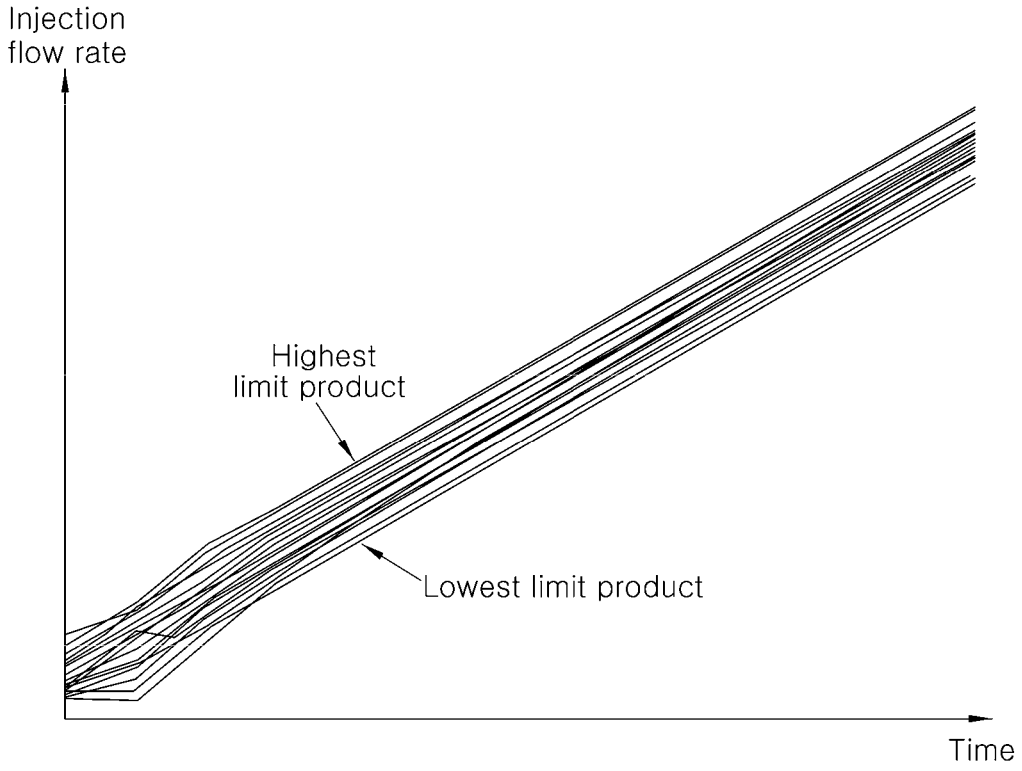
FIG. 7 is a graph illustrating the relationship of injection flow rates with respect to injection times in a plurality of injectors.

That is, in time-specific injection flow rates of the injector, as illustrated in FIG. 7, in both an injector, the quality of which is at the lowest limit, and an injector, the quality of which is at the highest limit, injection flow rate absolute deviations in the low flow rate range are similar to injection flow rate absolute deviations in the high flow rate range.

Thus, in the related art, a method of compensating for an injection flow rate by multiplication of flow rate deviations has been suggested. However, in this case, the amount of injection compensation in a low flow rate range is smaller than the amount of injection compensation in a high flow rate range. Accordingly, compensation for injection deviations is not properly performed in a low flow rate operating range.

In this regard, according to the present disclosure, in a low flow rate injection operating condition, when a cylinder-specific engine roughness deviation is relatively large, the cylinder-specific lambda deviation in relation to the cylinder-specific engine roughness deviation is learned, the cylinder-specific amount of injection compensation is calculated using the learned value, and compensation is performed by addition/subtraction by distributing the amount of injection compensation to a cylinder-specific target amount of injection. Here, a total amount of injection injected to the entire cylinders is maintained without being changed.

Accordingly, the injection deviation compensation is reliably performed in the low flow rate injection operating range, so that a dual injection mode may be extensively used in the low flow rate injection operating range. This can improve fuel efficiency and an EM while preventing changes in revolutions per minute (RPM) or air-fuel ratio occurring in injection mode transition, since the transition from a dual injection mode to a single injection mode is unnecessary.

In addition, in the present disclosure, it is possible to determine whether or not the low flow rate injection operating range is satisfied in accordance with a target injection time of the injector, an engine RPM, and the vehicle speed.

Particularly, when the target injection time of the injector is within a predetermined time, the engine RPM is less than a predetermined RPM, and the vehicle speed is less than a predetermined vehicle speed, it may be determined that the low flow rate injection operating range is satisfied.

In addition, in the present disclosure, whether or not a purging operation is active, a coolant temperature, and the engine roughness deviation may be reviewed as an operating condition in which the injection compensation is completed. Whether or not an injection compensation operating condition is satisfied may be determined by such a condition.

Particular, when the purging is inactivated, the coolant temperature exceeds a predetermined temperature, and a maximum value of the engine roughness deviation exceeds a predetermined value, it may be determined that the injection compensation operating condition is satisfied.

Figure 1:
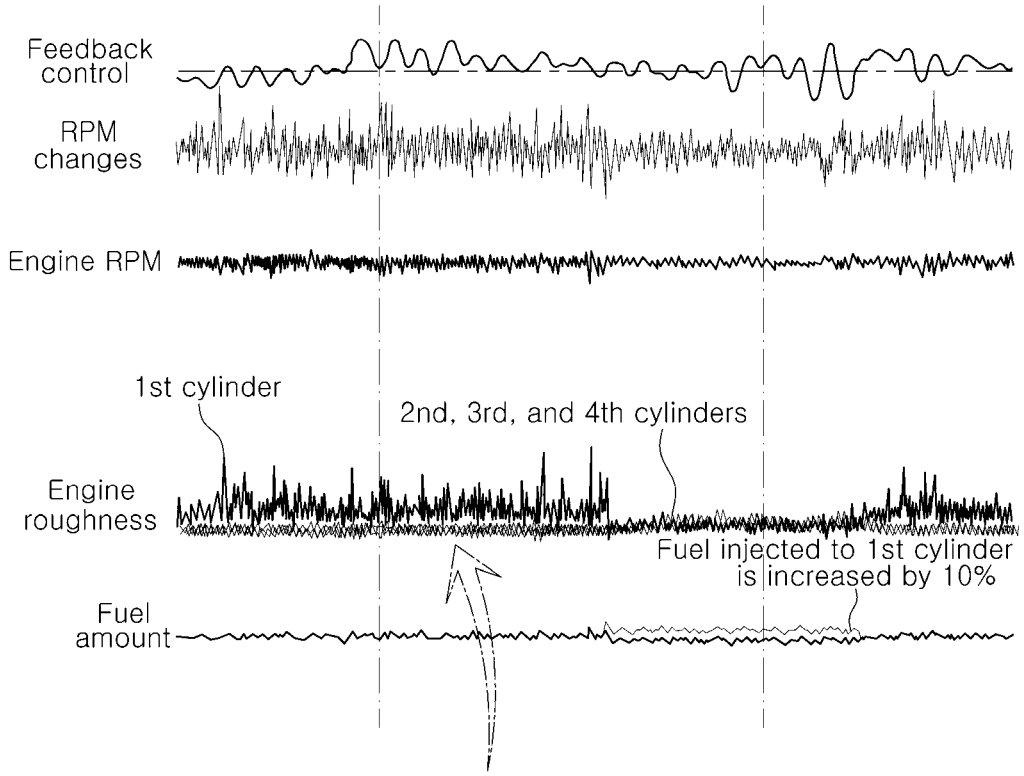
FIG. 1 illustrates a behavior in which engine roughness is increased by an insufficient injection flow rate of a specific cylinder.
Figure 2:
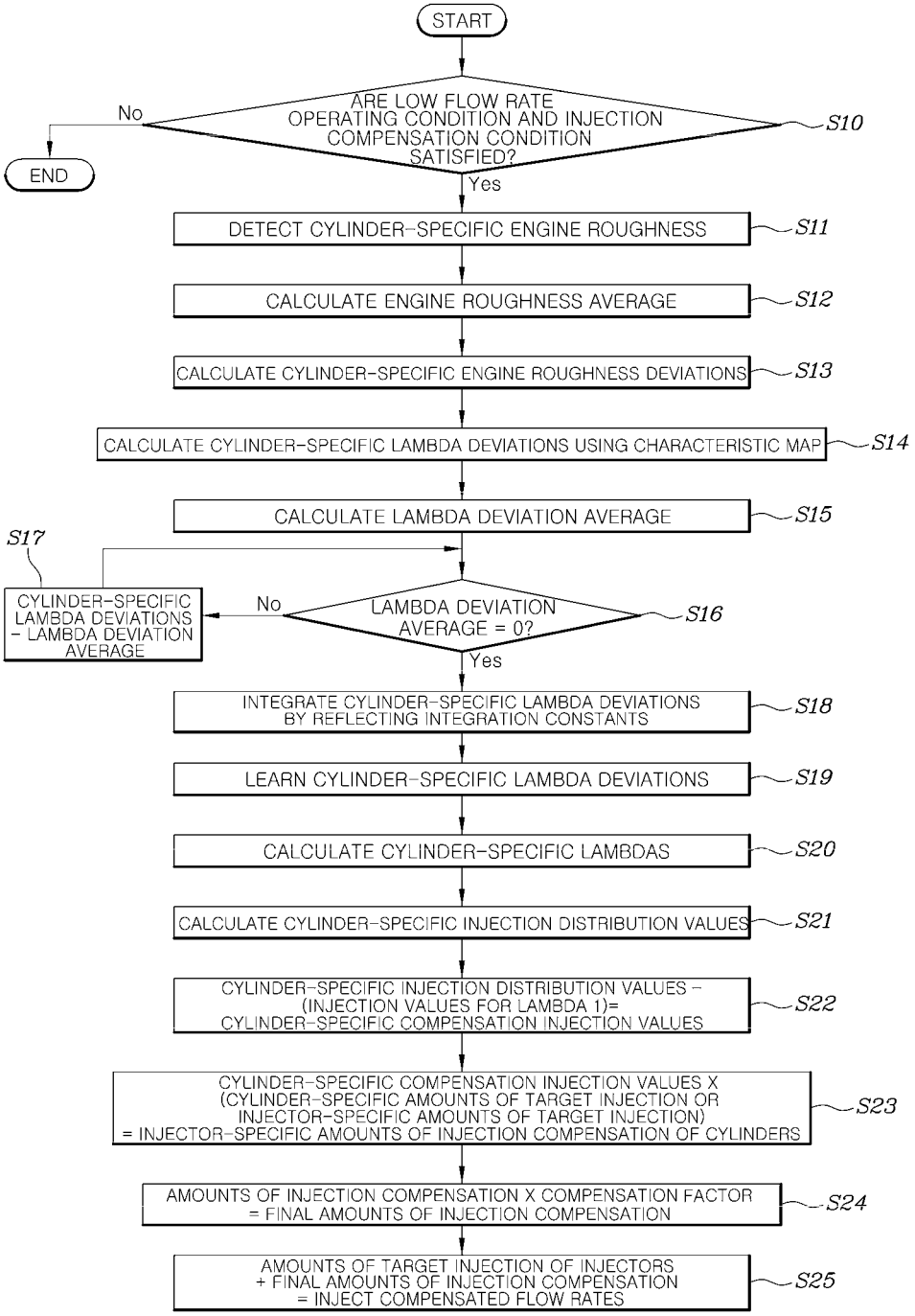
FIG. 2 is a flowchart illustrating process steps of a method of determining fuel injection deviations of injectors according to an exemplary embodiment of the present disclosure.
Figure 5:
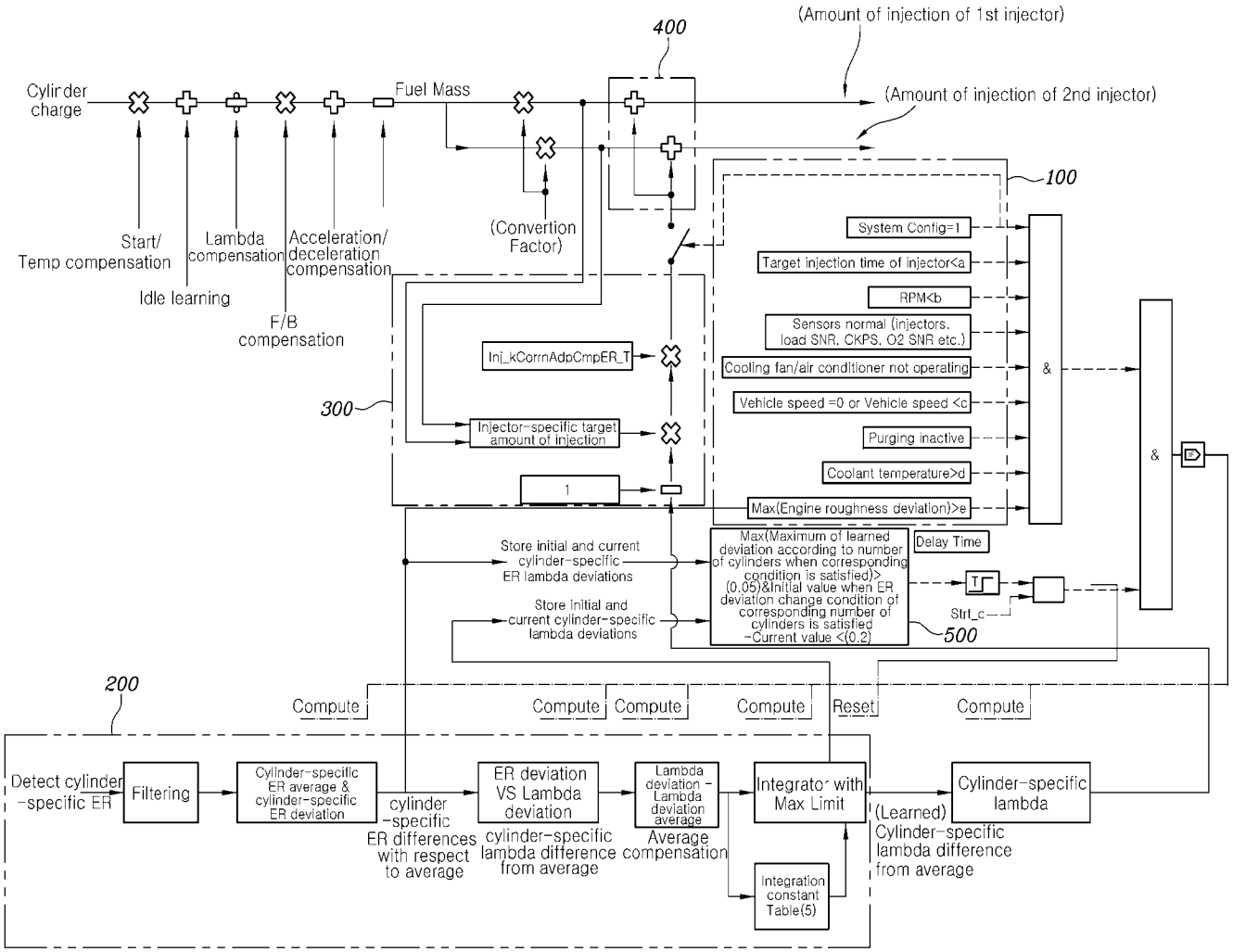
FIG. 5 is a block diagram specifically illustrating the system for determining fuel injection deviations of injectors according to the present disclosure.

Referring to FIGS. 2 and 5, the step of learning the lambda deviation will be described in more detail. First, values of engine roughness (ER) according to cylinders, i.e. cylinder-specific values of engine roughness, are detected. Here, the cylinder-specific engine roughness may be detected by measuring angular velocities of the crankshaft and filtering an intended signal from among the measured angular velocities. A detailed description of the method of detecting the engine roughness will be omitted, since the engine roughness can be detected by any method well known in the art.

Subsequently, an engine roughness average is calculated from the cylinder-specific values of engine roughness, and cylinder-specific engine roughness deviations are calculated from differences between the engine roughness average and the cylinder-specific values of engine roughness.

In addition, cylinder-specific lambda deviations regarding cylinder-specific engine roughness deviations are calculated using the characteristic map. The cylinder-specific lambda deviations are learned by integrating the cylinder-specific lambda deviations. For example, the cylinder-specific lambda deviations may be learned by filtering cylinder-specific lambda deviations that have been input for a predetermined cycle by bringing the input cylinder-specific lambda deviations to pass through an integrator.

Here, in the process of learning the learned cylinder-specific lambda deviations, a total of the lambda deviations may be calculated to be zero (0). However, in some cases, the total of the lambda deviations may be calculated to be greater or smaller than 0.

Accordingly, in the present disclosure, a lambda deviation average is calculated from the cylinder-specific lambda deviations. If the lambda deviation average is 0, the cylinder-specific lambda deviations are learned by integrating the cylinder-specific lambda deviations.

In contrast, when the lambda deviation average is not 0, compensation is performed by subtracting the lambda deviation average from the cylinder-specific lambda deviations, so that the lambda deviation average is 0. Thus, when the lambda deviation average is 0, the cylinder-specific lambda deviations are learned by integrating the cylinder-specific lambda deviations.

In addition, the cylinder-specific lambda deviations may be learned by reflecting table values of integration constants corresponding to the cylinder-specific lambda deviation.

The step of calculating the amount of injection compensation will be described in more detail. First, a cylinder-specific lambda is calculated using the learned cylinder-specific lambda deviations, and a cylinder-specific injection distribution value necessary for the cylinder-specific lambda to be a lambda average is calculated.

In addition, a cylinder-specific compensation injection value is calculated by subtracting an injection value corresponding to lambda 1 from the cylinder-specific injection distribution value.

Subsequently, a cylinder-specific amount of injection compensation is calculated by multiplying the cylinder-specific compensation injection value with a cylinder-specific target amount of injection.

That is, the cylinder-specific injection deviation can be compensated for by calculating an amount of injection compensation for the cylinder-specific lambda deviation.

The present disclosure is applicable to an engine provided with dual injectors. In the step of calculating the amount of injection compensation, in a dual-injector engine in which the cylinder is provided with two injectors, an injector-specific amount of injection compensation of the cylinder is calculated by multiplying the compensation injection value with an injector-specific target amount of injection of the cylinder.

That is, injector-specific injection deviations may be compensated for by calculating amounts of injection compensation of the cylinder according to the injectors.

In addition, the amount of injection compensation may be multiplied with a compensation factor according to the target injection time.

Here, 0≤compensation factor≤1.

For example, when the target injection time exceeds a predetermined reference time, the compensation factor may be set to be 0, the amount of injection compensation is not compensated for the target amount of injection. If the target injection time is equal to or less than the predetermined reference time, the compensation factor is set to be 1, so that the amount of injection compensation may be compensated for the target amount of injection.

Figure 3:
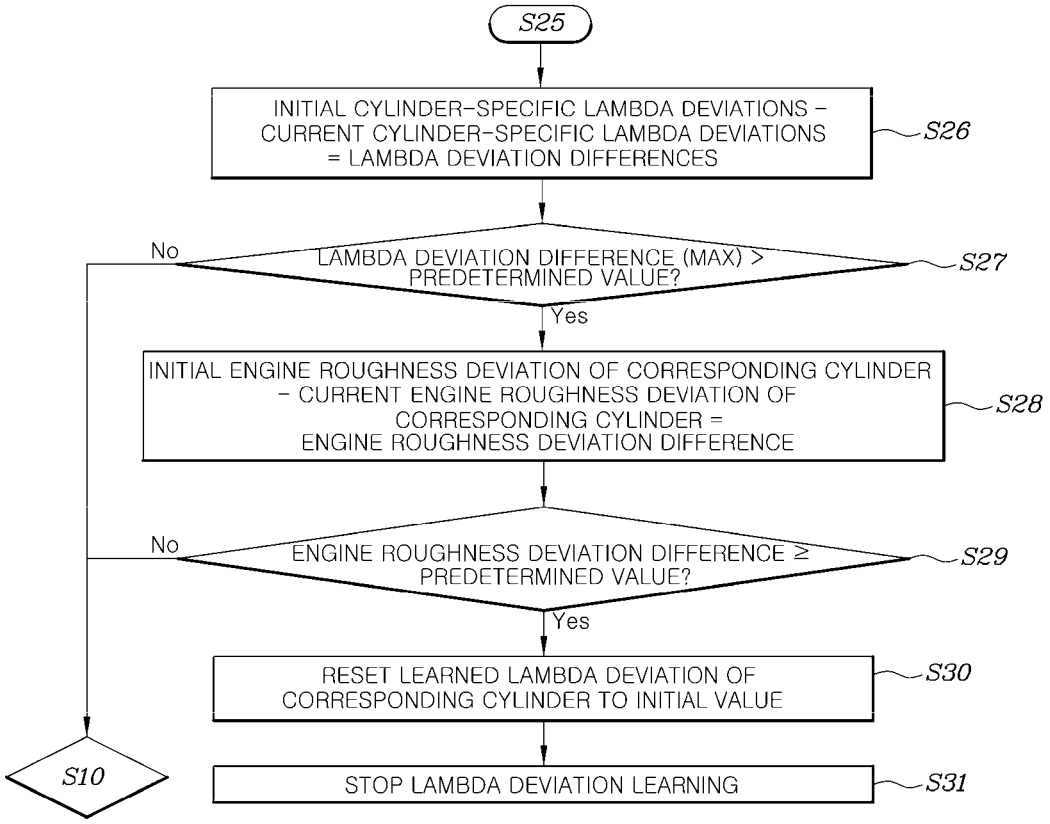
FIG. 3 is a flowchart illustrating a control process for determining the effectiveness of a fuel injection deviation compensation logic according to an exemplary embodiment of the present disclosure.

Referring to FIGS. 3 and 5, in the present disclosure, after the step of compensating for the amount of injection compensation, when the engine roughness deviation of a cylinder, in which the injection compensation has been completed, is equal to or greater than a predetermined value, the learned lambda deviation of the corresponding cylinder may be reset to an initial value.

This process may be described in detail in a stepwise manner. The method further includes: after the step of compensating for the amount of injection compensation, a step of calculating lambda deviation differences between initial cylinder-specific lambda deviations and current cylinder-specific lambda deviations; a step of calculating an engine roughness deviation difference between an initial engine roughness deviation and a current engine roughness deviation of the corresponding cylinder when a maximum value of the lambda deviation differences exceeds a predetermined value; and a step of resetting the learned lambda deviation of the corresponding cylinder to an initial value when the engine roughness deviation difference is equal to or greater than a predetermined value.

That is, in a case in which the learned lambda deviation difference between before and after the injection compensation is 10% or greater, when the engine roughness deviation of the cylinder, in which the injection compensation is completed, is not proved to be 5 or more, it is determined that the roughness deviation is caused by a reason other than the lambda deviation due to the injection deviation, and the learned lambda value is reset to an initial value. Here, when the vehicle is restarted, relearning is performed.

Figure 4:
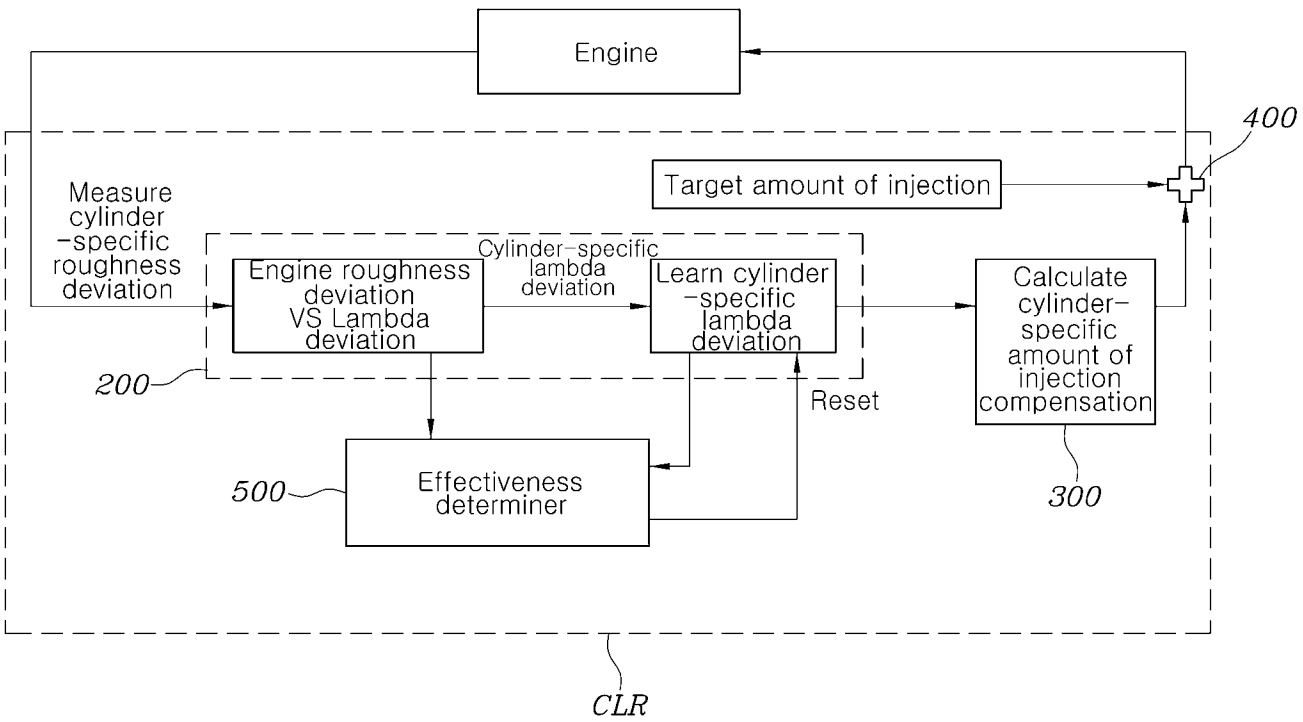
FIG. 4 is a block diagram schematically illustrating a system for determining fuel injection deviations of injectors according to an exemplary embodiment of the present disclosure.

Referring to FIGS. 4 and 5, a system for compensating for fuel injection deviations of an injector generally includes an operating condition determiner 100, a lambda deviation learner 200, a compensation calculator 300, and an injection compensator 400.

First, the operating condition determiner 100 determines whether or not an injection compensation operating condition is satisfied in the low flow rate injection operating range, on the basis of output values reflecting the traveling states of the vehicle.

In addition, the lambda deviation learner 200 learns cylinder-specific lambda deviations regarding cylinder-specific engine roughness deviation using a characteristic map defining the relationship between engine roughness deviations and lambda deviations.

The compensation calculator 300 calculates cylinder-specific amounts of injection compensation for removing the learned cylinder-specific lambda deviations.

In addition, the injection compensator 400 compensates for amounts of injection compensation of the injector by adding the cylinder-specific amounts of injection compensation to the cylinder-specific target amounts of injection.

In addition, the system may further include an effectiveness determiner 500 determining whether or not the injection compensating operation is effective to reduce engine roughness deviations by determining whether or not the engine roughness deviation of the cylinder, in which the injection compensation is completed, is equal to or greater than a predetermined value.

Hereinafter, overall control flows of the method of compensating for fuel injection deviations will be described with reference to FIGS. 2 and 5. During traveling of the vehicle, whether or not the low flow rate injection operating range condition is satisfied is determined in S10.

For example, when the target injection time of the injector is a or less, the engine RPM is less than b or an idle RPM, and a vehicle speed is less than c or 0, whether or not the flow rate injection operating range condition is satisfied is determined.

In addition, in S10, whether or not an injection compensation operating condition is satisfied is determined.

For example, when the purging is inactive, the coolant temperature exceeds d, and a maximum value of cylinder-specific engine roughness deviation exceeds e, it is determined that the injection compensation operating condition is satisfied. In addition, whether or not a cooling fan and an air conditioner are inactive may be further determined as the compensation operating condition. In addition, whether or not sensors, such as a crankshaft position sensor or an oxygen sensor, malfunction may be further determined.

If it is determined that the low flow rate injection operating range condition and the injection compensating operation condition are satisfied, cylinder-specific values of engine roughness are detected in S11, and an engine roughness average is calculated from the cylinder-specific values of engine roughness in S12.

In addition, cylinder-specific engine roughness deviations are calculated from differences between the engine roughness average and the cylinder-specific values of engine roughness in S13, and cylinder-specific lambda deviations regarding the cylinder-specific engine roughness deviations are calculated using the characteristic map in S14.

Subsequently, a lambda deviation average is calculated from the cylinder-specific lambda deviations in S15, and whether or not the calculated lambda deviation average is 0 is determined in S16.

If the calculated lambda deviation average is determined not to be 0 in S16, the lambda deviation average is subtracted from the cylinder-specific lambda deviations in S17, so that the lambda deviation average is 0 by compensation.

In addition, when the lambda deviation average is 0 or the lambda deviation average is 0 by compensation as above, cylinder-specific lambda deviations are learned by integrating the cylinder-specific lambda deviations in S19.

For example, when the lambda deviation of the first cylinder is 0.16, the lambda deviation of the second cylinder is 0, the lambda deviation of the third cylinder is −0.04, and the lambda deviation of the fourth cylinder is −0.08, a total of the lambda deviations of the four cylinders is 0.04, and a lambda deviation average thereof is 0.01.

Here, when 0.01 is subtracted from the lambda deviations of the cylinders, the lambda deviation of the first cylinder is 0.15, the lambda deviation of the second cylinder is −0.01, the lambda deviation of the third cylinder is −0.05, and the lambda deviation of the fourth cylinder is −0.09. Consequently, the total of the lambda deviations of the four cylinders is 0, and the lambda deviation average thereof is also 0.

| | #1 Cylinder | #2 Cylinder | #3 Cylinder | #4 Cylinder | Total | Average |
|---|---|---|---|---|---|---|
| Lambda deviation | 0.16 | 0.00 | −0.04 | −0.08 | 0.04 | 0.01 |
| Lambda deviation-Lambda deviation average | 0.15 | −0.01 | −0.05 | −0.09 | 0.00 | 0 |

In addition, in the process of learning the lambda deviations, the cylinder-specific lambda deviations are learned by reflecting table values of integration constants corresponding to the cylinder-specific lambda deviations in S18.

For example, it may be set such that the lambda deviation learning is not performed when the lambda deviation is 0. The table values may be set such that the lambda deviation learning is more rapidly performed with increases in the lambda deviations while being more slowly performed with decreases in the lambda deviations.

Subsequently, cylinder-specific lambdas are calculated from the learned cylinder-specific lambda deviations in S20, and a cylinder-specific injection distribution value regarding the cylinder-specific lambdas are calculated in S21.

In addition, a cylinder-specific compensation injection value is calculated by subtracting an injection value corresponding to lambda 1 from the cylinder-specific injection distribution value in S22, and cylinder-specific amounts of injection compensation are calculated by multiplying the cylinder-specific compensation injection value with the cylinder-specific target amount of injection in S23.

In the case of a dual-injector engine as described above, injector-specific amounts of injection compensation of the cylinders may be calculated by multiplying the compensation injection value with injector-specific target amounts of injection of the cylinders.

Here, the amounts of injection compensation may be multiplied with a compensation factor according to the target injection time, so that the injection compensation is only performed in an injection operating range having a target injection time not exceeding a predetermined time, in S24.

Subsequently, amounts of injection may be compensated for by adding the cylinder-specific amounts of injection compensation to the cylinder-specific target amounts of injection, so that the injectors disposed in the cylinders, respectively, inject compensated amounts of fuel in S25.

Accordingly, the injection deviation compensation is reliably performed in the low flow rate operating range, so that the dual injection mode may be extensively used in the low flow rate operating range. This can improve the fuel efficiency and the EM while preventing RPM changes or air-fuel ratio changes occurring due to unnecessary transition of the injection mode from a dual injection mode to a single injection mode.

Here, it may be necessary to review whether or not the injection compensation is caused by different amounts of fuel due to injector qualities.

In this regard, as illustrated in FIGS. 3 and 5, after the injection compensation, lambda deviation differences between initial cylinder-specific lambda deviations and current cylinder-specific lambda deviations are calculated in S26, and whether or not a maximum value among the calculated differences exceeds a predetermined value is determined in S27.

If the maximum value is determined to exceed the predetermined value in S27, an engine roughness deviation difference between an initial engine roughness deviation and a current engine roughness deviation of the corresponding cylinder is calculated in S28.

Subsequently, whether or not the engine roughness deviation difference is equal to or greater than a predetermined value is determined in S29. If the engine roughness deviation difference is determined to be equal to or greater than the predetermined value, the learned lambda deviation of the corresponding cylinder is reset to the initial value in S30, and the lambda deviation learning is controlled to be stopped in S31.

That is, after the lambda deviation of a cylinder is significantly reduced by the injection compensation, if there is a significant difference in the engine roughness deviation of the corresponding cylinder, it is determined that the roughness deviation is caused by a reason other than the lambda deviation due to the injection deviation, and the learned lambda deviation of the cylinder is reset to an initial value.

Although the foregoing embodiments of the present disclosure have been described for illustrative purposes, those skilled in the art will appreciate that various modifications, additions and substitutions are possible, without departing from the scope and spirit of the present disclosure as disclosed in the accompanying claims.

What is claimed is:

1. A method of compensating for fuel injection deviations of injectors, the method comprising:

in a low flow rate injection operating range, learning, by a controller, cylinder-specific lambda deviations regarding cylinder-specific engine roughness deviations using a characteristic map defining a relationship between engine roughness deviations and lambda deviations;

calculating, by the controller, cylinder-specific amounts of injection compensation necessary to remove the cylinder-specific lambda deviations; and compensating for amounts of injection of the injectors by adding the cylinder-specific amounts of injection compensation to cylinder-specific target amounts of injection, wherein learning the cylinder-specific lambda deviations comprises:

detecting cylinder-specific values of engine roughness;

calculating an engine roughness average of the cylinder-specific values of engine roughness;

calculating the cylinder-specific engine roughness deviations from differences between the engine roughness average and the cylinder-specific values of engine roughness;

calculating the cylinder-specific lambda deviations regarding the cylinder-specific engine roughness deviations using the characteristic map; and learning the cylinder-specific lambda deviations by integrating the cylinder-specific lambda deviations.

2. The method according to claim 1, wherein whether or not a condition of the low flow rate injection operating range is satisfied is determined in accordance with a target injection time of one of the injectors, revolutions per minute of an engine, and a vehicle speed.

3. The method according to claim 2, wherein whether or not a condition of compensation for the amounts of injection is satisfied is determined in accordance with whether or not a purging operation is active, a temperature of coolant for the engine, and the cylinder-specific engine roughness deviations.

4. The method according to claim 1, wherein, when a target injection time of one of the injectors is within a predetermined time, revolutions per minute of an engine are less than predetermined revolutions per minute, and a vehicle speed is less than a predetermined vehicle speed, the low flow rate injection operating range is determined to be satisfied.

5. The method according to claim 4, wherein, when a purging operation is inactivated, a temperature of coolant for the engine exceeds a predetermined temperature, and a maximum value of the cylinder-specific engine roughness deviations exceeds a predetermined value, an injection compensation operating condition is determined to be satisfied.

6. The method according to claim 1, wherein learning the cylinder-specific lambda deviations further comprises:

calculating a lambda deviation average of the cylinder-specific lambda deviations;

when the lambda deviation average is not 0, compensating the lambda deviation average to be 0 by subtracting the lambda deviation average from the cylinder-specific lambda deviations; and when the lambda deviation average is 0, learning the cylinder-specific lambda deviations by integrating the cylinder-specific lambda deviations.

7. The method according to claim 6, wherein the cylinder-specific lambda deviations are learned by reflecting table values of integration constants corresponding to the cylinder-specific lambda deviations.

8. The method according to claim 1, wherein calculating the cylinder-specific amounts of injection compensation comprises:

calculating a cylinder-specific lambda from the cylinder-specific lambda deviations;

calculating cylinder-specific injection distribution values necessary for the cylinder-specific lambda to form a lambda average;

calculating cylinder-specific compensation injection values by subtracting an injection value corresponding to lambda 1 from the cylinder-specific injection distribution values; and calculating the cylinder-specific amounts of injection compensation by multiplying the cylinder-specific compensation injection values with the cylinder-specific target amounts of injection.

9. The method according to claim 8, wherein, in the calculating the cylinder-specific amounts of injection compensation, when a dual-injector structure in which two injectors are disposed in each of cylinders is used, injector-specific amounts of injection compensation of the cylinders are calculated by multiplying the cylinder-specific compensation injection values with injector-specific target amounts of injection of the cylinders.

10. The method according to claim 8, wherein the cylinder-specific amounts of injection compensation are multiplied with a compensation factor according to a target injection time, where 0≤the compensation factor≤1.

11. The method according to claim 1, wherein, after the compensation for the amounts of injection, when engine roughness deviation of a cylinder among the cylinders, in which the compensation for the amounts of injection is completed, is equal to or greater than a predetermined value, the cylinder-specific lambda deviation of the cylinder is reset to an initial value.

12. The method according to claim 1, further comprising, after the compensating for amounts of injection:

calculating lambda deviation differences between initial cylinder-specific lambda deviations and current cylinder-specific lambda deviations;

when a maximum value among the lambda deviation differences exceeds a predetermined value, calculating an engine roughness deviation difference between an initial engine roughness deviation and a current engine roughness deviation of the corresponding cylinder; and when the engine roughness deviation difference exceeds a preset value, resetting the lambda deviation of the corresponding cylinder to an initial value.

13. A system for compensating for fuel injection deviations of injectors, the system comprising a controller configured to:

determine whether or not an injection compensation operating condition is satisfied in a low flow rate injection operating range, in accordance with output values reflecting traveling states of a vehicle;

learn cylinder-specific lambda deviations regarding cylinder-specific engine roughness deviation using a characteristic map defining a relationship between engine roughness deviation and lambda deviations;

calculate cylinder-specific amounts of injection compensation necessary for removing the cylinder-specific lambda deviations; and compensate for amounts of injection of the injectors by adding the cylinder-specific amounts of injection compensation to cylinder-specific target amounts of injection, wherein the controller configured to learn the cylinder-specific lambda deviations by detecting cylinder-specific values of engine roughness;

calculating an engine roughness average of the cylinder-specific values of engine roughness;

calculating the cylinder-specific engine roughness deviations from differences between the engine roughness average and the cylinder-specific values of engine roughness;

calculating the cylinder-specific lambda deviations regarding the cylinder-specific engine roughness deviations using the characteristic map; and learning the cylinder-specific lambda deviations by integrating the cylinder-specific lambda deviations.

14. The system according to claim 13, wherein the controller is further configured to determine whether or not an injection compensating operation is effective to reduce the engine roughness deviations by determining whether or not the engine roughness deviation of a cylinder, in which the compensation for the amounts of injection is completed, is equal to or greater than a predetermined value.

* * * * *